US009352883B2

(12) United States Patent
Tavenner et al.

(10) Patent No.: US 9,352,883 B2
(45) Date of Patent: May 31, 2016

(54) LIQUID STORAGE, ISOLATION AND DISPENSING ASSEMBLY

(71) Applicant: WineStor, LLC, Mountain View, CA (US)

(72) Inventors: Ronald Scott Tavenner, Mountain View, CA (US); Michael Jonathan Liebowitz, Concord, CA (US)

(73) Assignee: WineStor, LLC, Mountain View, CA (US)

( * ) Notice: Subject to any disclaimer, the term of this patent is extended or adjusted under 35 U.S.C. 154(b) by 117 days.

(21) Appl. No.: 14/250,067

(22) Filed: Apr. 10, 2014

(65) Prior Publication Data

US 2015/0291322 A1 Oct. 15, 2015

(51) Int. Cl.

| | |
|---|---|
| ***B65D 88/34*** | (2006.01) |
| ***B65D 41/04*** | (2006.01) |
| ***A47G 19/12*** | (2006.01) |
| ***B65D 25/14*** | (2006.01) |
| ***B65D 25/42*** | (2006.01) |

(Continued)

(52) U.S. Cl.

CPC ..... *B65D 41/0407* (2013.01); *A47G 19/12* (2013.01); *B65D 25/14* (2013.01); *B65D 25/42* (2013.01); *B65D 85/72* (2013.01); *A47G 23/0241* (2013.01); *A47G 2200/02* (2013.01)

(58) Field of Classification Search

CPC .. B65D 81/245; B65D 88/34; B65D 41/0407; B65D 25/42; A47G 2200/02; A47G 19/12

USPC ..... 222/500, 67, 249, 250, 562, 521; 220/216, 298, 300; 215/329

See application file for complete search history.

(56) References Cited

U.S. PATENT DOCUMENTS 3,256,977 A * 6/1966 Pettersen ..... B65D 81/245 206/216

3,349,945 A 10/1967 Baker (Continued)

FOREIGN PATENT DOCUMENTS

| | | | |
|---|---|---|---|
| FR | 2597447 | A1 | 10/1987 |
| WO | 8908420 | A1 | 9/1989 |
| WO | 2008088712 | A2 | 7/2008 |

OTHER PUBLICATIONS

International Search Report and Written Opinion of the International Searching Authority dated Jan. 20, 2014 for corresponding PCT Patent Application No. PCT/US2013/064299, 7 pages.

*Primary Examiner* — Frederick C Nicolas
*Assistant Examiner* — Robert Nichols, II
(74) *Attorney, Agent, or Firm* — Haynes Beffel & Wolfeld LLP; James F. Hann

(57) ABSTRACT

A liquid storage, isolation and dispensing assembly includes a container, a float and a top. The container includes a sidewall having an inner surface, a lower part, and an upper part. At least a portion of the inner surface of the lower part has a constant cross-sectional shape and size. The upper part includes an inwardly extending ledge with a cutout formed therethrough. The float has a sealing edge generally conforming to the size and shape of the inner surface portion. The sealing edge and the cutout are configured to permit the float to be passed into the lower part of the container with a portion of the sealing edge passing through the cutout. The top is mountable to the upper part and has a lug configured to pass through the cutout in the ledge for mounting the top on the container.

16 Claims, 14 Drawing Sheets

(51) Int. Cl.
*B65D 85/72* (2006.01)
*A47G 23/02* (2006.01)

(56) References Cited

U.S. PATENT DOCUMENTS

| | | | | |
|---|---|---|---|---|
| 3,974,758 | A | 8/1976 | Stone, Jr. | |
| D269,596 | S | 7/1983 | Fowkes | |
| 4,723,674 | A | 2/1988 | Nunes | |
| D300,107 | S | 3/1989 | Trombly | |
| 5,415,317 | A | 5/1995 | Hager | |
| D359,196 | S | 6/1995 | Nichols | |
| D433,225 | S | 11/2000 | Deiss et al. | |
| 7,017,768 | B2 | 3/2006 | Iskierka | |
| 7,494,025 | B2 * | 2/2009 | Porter | B65D 39/02 220/580 |
| D600,121 | S | 9/2009 | Marotti et al. | |
| D612,197 | S | 3/2010 | Chan | |
| D671,786 | S | 12/2012 | Lin | |
| 8,365,931 | B2 | 2/2013 | Rees et al. | |
| D683,184 | S | 5/2013 | Lin | |
| 8,573,402 | B2 | 11/2013 | Cimino | |
| 2003/0102311 | A1 | 6/2003 | Brady | |
| 2007/0194057 | A1 * | 8/2007 | Gehl | G01F 23/00 222/386 |
| 2008/0110847 | A1 * | 5/2008 | Rees | B65D 81/245 215/264 |
| 2014/0103042 | A1 | 4/2014 | Tavenner et al. | |

* cited by examiner

LIQUID STORAGE, ISOLATION AND DISPENSING ASSEMBLY

CROSS-REFERENCE TO OTHER APPLICATIONS

This application is related to commonly assigned U.S. patent application Ser. No. 13/651,352 filed 12 Oct. 2012, and entitled Liquid Storage, Isolation and Dispensing Assembly.

BACKGROUND OF THE INVENTION

Some beverages, such as wine, are susceptible to undergoing chemical changes once the beverage container has been opened, primarily due to contact with the oxygen in air. However, often the wine or other beverage from the newly open container is not consumed or otherwise used. Several techniques have been devised for keeping an open bottle of wine from changing after being opened. One way involves removing the air from the container by either collapsing the container, such as the bag in a box concept, or dropping marbles into the wine bottle to reduce the headspace. Another way is to replace all or most of the air in the bottle, which is about 21% oxygen, with a relatively inert gas such as nitrogen. This is typically accomplished using a spray can of nitrogen followed by resealing the bottle. Another way is to partially evacuate the headspace using a vacuum pump and a special bottle closure. A further way is to pour the wine into a smaller bottle so that there is less headspace. The exposure of other beverages, such as coffee, to air is also a problem. While many of these techniques can be useful to help preserve the quality of a beverage which has not been consumed, they all suffer from one or more of the following shortcomings: being only partially effective, hard to use, expensive, and providing less than elegant solutions, as well as often requiring repeat purchases.

BRIEF SUMMARY OF THE INVENTION

An example of a liquid storage, isolation and dispensing assembly includes a container, a float and a top. The container includes a sidewall having an inner surface, a lower part, and an upper part extending from the lower part. At least a portion of the inner surface of the lower part has a constant cross-sectional shape and size. The upper part includes a ledge extending radially inwardly from the inner surface, the ledge having a cutout formed through the ledge. The float has a sealing edge generally conforming to the size and shape of the portion of the inner surface. The sealing edge and the cutout are configured to permit the float to be passed into the lower part of the container with a portion of the sealing edge passing through the cutout. The top is mountable to the upper part and has a lug configured to pass through the cutout in the ledge for mounting the top at a first position on the container.

The liquid storage, isolation and dispensing assembly can include one or more the following. The portion of the inner surface can have a cylindrical shape and the entire upper part can flare outwardly to accommodate pouring from the container in any direction. The ledge can include first and second cutouts; the first and second cutouts can be located on opposite sides of the ledge. The ledge can have the same number of cutouts as the top has lugs. The lug and the ledge can be configured to permit the top to be rotated relative to the container from the first position to a second position with the lug offset from the cutout thereby securing the top to the container.

A method for assembling a liquid storage, isolation and dispensing assembly can be carried out as follows. A container is accessed. The container has a sidewall with an inner surface, a lower part, and an upper part extending from the lower part. At least a portion of the inner surface of the lower part has a constant cross-sectional shape and size. The upper part includes a ledge extending radially inwardly from the inner surface. A cutout is formed through the ledge. A float, having a sealing edge generally conforming to the size and shape of said portion of the inner surface, is oriented so that the sealing edge is aligned with the cutout. The float is inserted into the lower part of the container by passing the sealing edge through the cutout, the cutout being configured to permit the sealing edge to pass through the cutout. A top is oriented opposite the upper part, the top having a lug configured to pass through the cutout in the ledge. The lug is inserted through the cutout in the ledge to mount the top to the container.

The method for assembling a liquid storage, isolation and dispensing assembly can include one or more the following. The accessing step can be carried out by accessing a container having a ledge comprising a plurality of cutouts formed through the ledge. The container accessing step can be carried out so that the top has M lugs and the sealing edge has N cutouts, N being greater than or equal to M. Following inserting the lug through the cutout in the ledge, the top can be secured to the container by rotating the top and the container relative to one another to position the lug offset from the cutout.

Other features, aspects and advantages of the present invention can be seen on review the drawings, the detailed description, and the claims which follow.

BRIEF DESCRIPTION OF THE DRAWINGS

FIG. 1 is an exploded side elevation view of a first example of a liquid storage, isolation and dispensing assembly.

FIG. 2 is a three-dimensional view of the top of the assembly of FIG. 1.

FIG. 3 is a three-dimensional view of the float of the assembly of FIG. 1.

FIG. 4 is a cross-sectional view of the assembly of FIG. 1 in an assembled condition with the float floating on the surface of the liquid within the container.

FIGS. 5-8 are simplified views showing the use of the assembly of FIG. 1.

FIG. 5 shows pouring a liquid into the container.

FIG. 6 shows placing the float through the open upper end of the container.

FIG. 7 shows the float resting at the upper surface of the liquid with the top mounted to the open upper end of the container.

FIG. 8 shows the liquid being poured from the container after the top has been removed and illustrates how the float naturally becomes repositioned within the container interior when the container is tilted to allow the liquid to be poured from the container.

FIG. 9 shows a second example of a liquid storage, isolation and dispensing assembly in which the container has an other than round cross-sectional shape and showing the top in a liquid sealing position.

FIG. 10 is a top plan view of the container of FIG. 9 showing the oval cross-sectional shape of the container and the spout-like pouring element created at the outwardly flared open upper end of the container.

FIG. 11 is a three-dimensional view of the float of the assembly of FIG. 9.

FIG. 12 is a three-dimensional view of the top of the assembly of FIG. 9.

FIG. 13 shows the structure of FIG. 9 but with the top removed and re-oriented 180° from the position of FIG. 9 placing the top in a liquid pouring position and creating a gap between the sealing element of the top and the inner surface of the container at the spout-like pouring element.

FIG. 14 shows the structure of FIG. 13 at a tilted, pouring orientation permitting the liquid within the container to flow through the gap and out of the container.

DETAILED DESCRIPTION OF THE INVENTION

Figure 1:
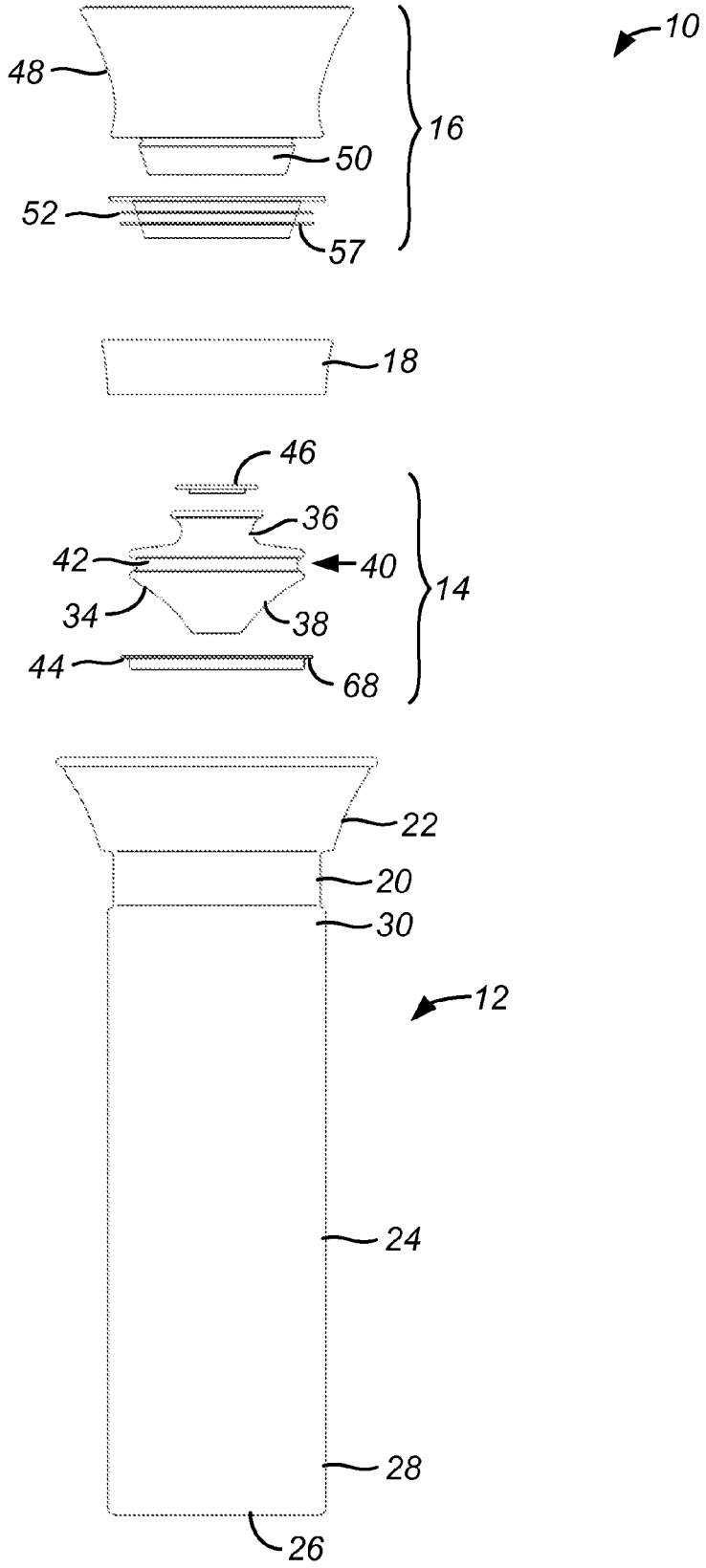
FIGS. 1-14 are identical to FIGS. 1-14 of the above-referenced U.S. patent application Ser. No. 13/651,352.
Figure 2:
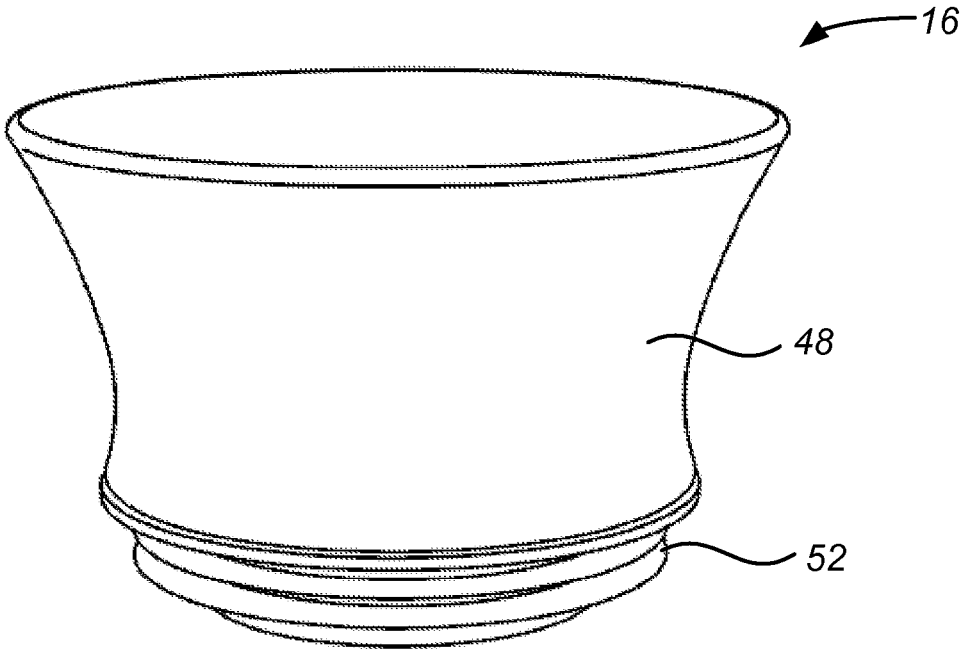
Figure 3:
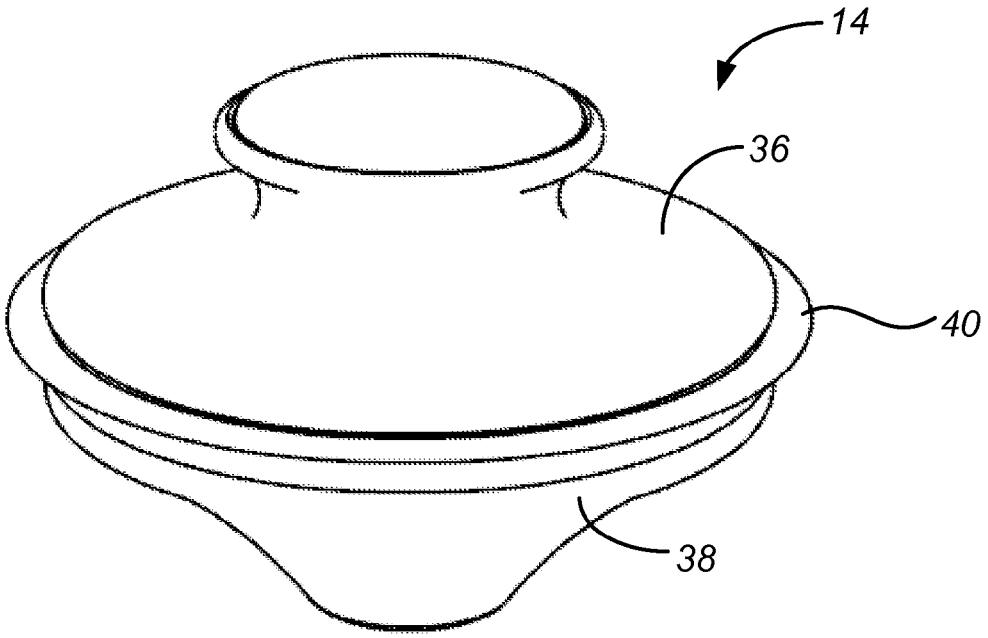

The following description will typically be with reference to specific structural embodiments and methods. It is to be understood that there is no intention to limit the invention to the specifically disclosed embodiments and methods but that the invention may be practiced using other features, elements, methods and embodiments. Preferred embodiments are described to illustrate the present invention, not to limit its scope, which is defined by the claims. Those of ordinary skill in the art will recognize a variety of equivalent variations on the description that follows. Like elements in various examples and embodiments are commonly referred to with like reference numerals.

The following description of FIGS. 1-14 is substantially identical to the description of FIGS. 1-14 of U.S. patent application Ser. No. 13/651,352 referred to above.

A first example of a liquid storage, isolation and dispensing assembly 10 is shown in FIG. 1 as including a carafe type container 12, a float 14 and a top 16. Container 12 includes a grip ring 18 which is positioned within a groove 20 at the open upper end 22 of container 12. Container 12 has a generally cylindrical side wall 24 extending from a bottom 26 at the lower end 28 of the sidewall to a position 30 adjacent to groove 20 at open upper end 22. Open upper end 22 is outwardly flared around its entire circumference to facilitate pouring.

Float 14 includes a float body 34 having a top portion 36 and a bottom portion 38 joined by a sealing edge 40. Top portion 36 is configured to form lifting handle. Sealing edge 40 includes a groove 42 housing a sealing edge skirt 44. Float 14 also includes a cap 46 which covers an opening at the top portion 36. Float 14 is shown in an assembled form in FIGS. 3 and 4.

Top 16 includes a top body 48 having a lower extension 50 to which a top sealing element 52 is mounted. See FIGS. 2 and 4 which show top 16 in an assembled form. Sealing element 52 and the sealing edge skirt 44 can be made of flexible, resilient material, such as high density polypropylene (HDPP), which should be compatible with the wine or other liquid to be held within container 12.

Figure 4:
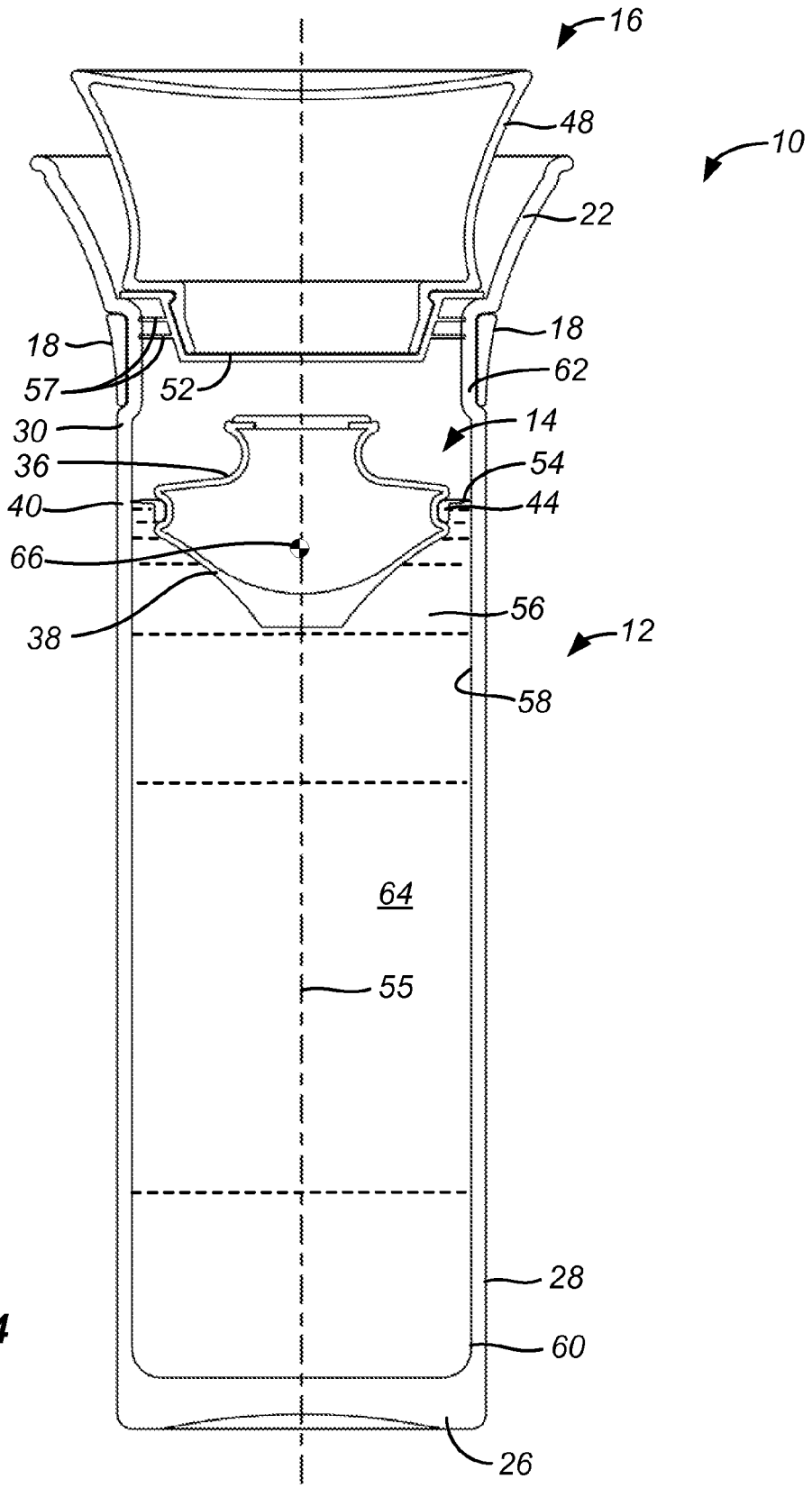

FIG. 4 is a cross-sectional view of the assembly 10 in an assembled condition with top 16 mounted to open upper end 22 and float 14 floating on the surface 54 of the liquid 56 within container 12. The inner surface 58 of container 12 is cylindrical in shape from position 30 just below grip ring 18 down to a position 60 at bottom 26 of container 12. The inner surface 58 of container 12 from position 30 down to position 60 defines a container axis 55. Inner surface 58 above position 30 has a smaller inner diameter than below the lower position 30 to help keep float 14 from inadvertently passing through open upper end 22 during use; that portion of inner surface can be referred to as a float retaining element 62. Sealing edge skirt 44 is sufficiently flexible to permit float 14 to be passed through open upper end 22 and past float retaining element 62 to get the float into the container interior 64. Float 14 has an axis generally parallel to, and typically coincident with, container axis 55. Float 14 is configured so that it is bottom-heavy with an axially-centered center of gravity 66 within bottom portion 38; this helps to ensure that float 14 remains upright within liquid 56. The weight and configuration of float 14 is designed based upon the expected specific gravity of liquid 56 so that sealing edge skirt 44 is generally coincident with liquid surface 54.

In some examples, the sealing edge skirt 44 may be arranged to be offset from, such as somewhat above, liquid surface 54 without creating an excessive area of exposed liquid surface 54. Also, in some examples float 14 could be designed so that the center of gravity 66 is aligned with sealing edge skirt 44 so that the float would be stably positioned on liquid surface 54 regardless of its orientation, that is with the top facing up or down. In addition, float 14 could be shaped, such as a flattened disk shaped member, so that it would float stably on the liquid regardless of whether the top were facing up or down. In some examples, the top portion could be at the level of the sealing edge skirt 44. Float 14 could, for example, be a flat disc having a sealing edge skirt 44 positioned between its two edges or along one of the two edges, or in some examples the sealing edge skirt 44 and could be positioned along both of the two edges.

During use the level of liquid surface 54 will change. To ensure that float 14 properly follows the liquid level at liquid surface 54, the outside diameter of sealing edge skirt 44 is made to be somewhat less than the inside diameter of inner surface 58 between positions 30 and 60. The difference between the two diameters can be chosen to create a minimal gap, such as about 0.03 inch (0.76 mm) to about 0.13 inch (3.3 mm). A larger gap will help ensure that float 14 freely follows liquid surface 54 but also exposes more of liquid 56 to the air above the float. Also, making skirt 44 out of a slippery material, such as PTFE, should help to ensure free movement of float 14 within container 12.

It should be noted that the flange elements 57 of top sealing element 52 would typically be deflected upwardly to rest on the inner surface 58 of container 12 when the top 16 is mounted to open upper end 22 of container 12. However, flange elements 57 are shown extending straight outwardly in FIG. 4 as an artifact of the drafting process. This artifact is also present in FIGS. 7, 9, 13 and 14.

Figure 5:
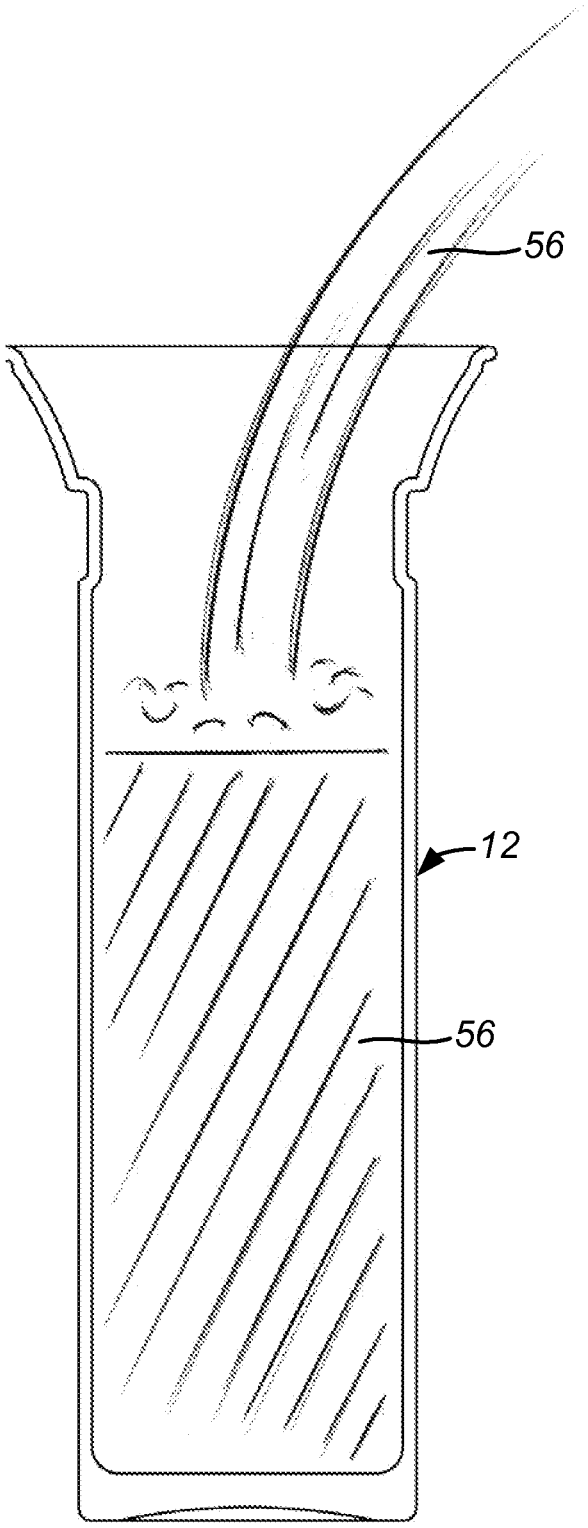
Figure 6:
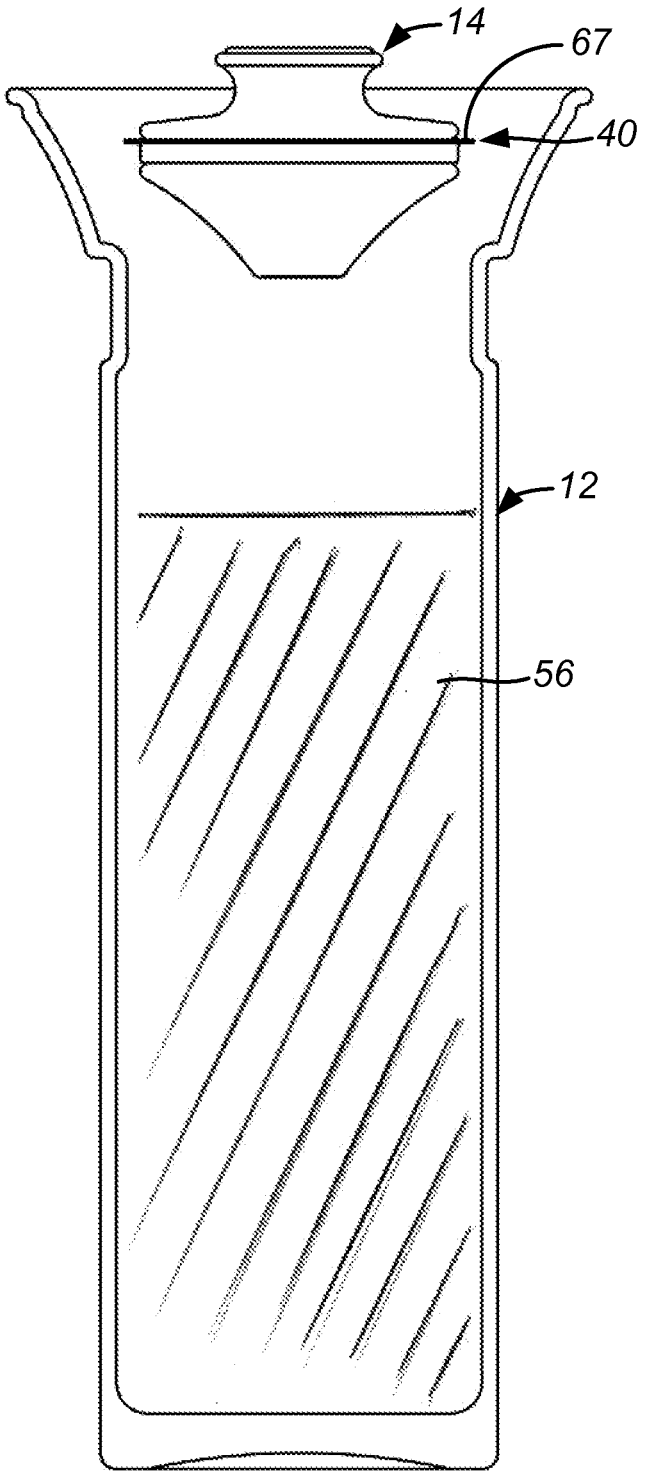

FIG. 5 shows pouring a liquid 56 into container 12. In some cases, in particular with certain still wines, it may be desired to provide additional aeration to the wine as it is poured into container 12, which can act as a serving carafe. In that case, float 14 can be placed into container 12 before all or part of liquid 56 is poured into the container. The liquid 56 landing on top portion 36 of float 14 will cause additional aeration of the wine. FIG. 6 shows float 14 being passed through the open upper end 22 of the container. Flange 67 of sealing edge skirt 44 is sufficiently flexible to permit float 14 to pass through float retaining element 62 and enter the cylindrical region of inner surface 58 between positions 30 and 60.

Figure 7:
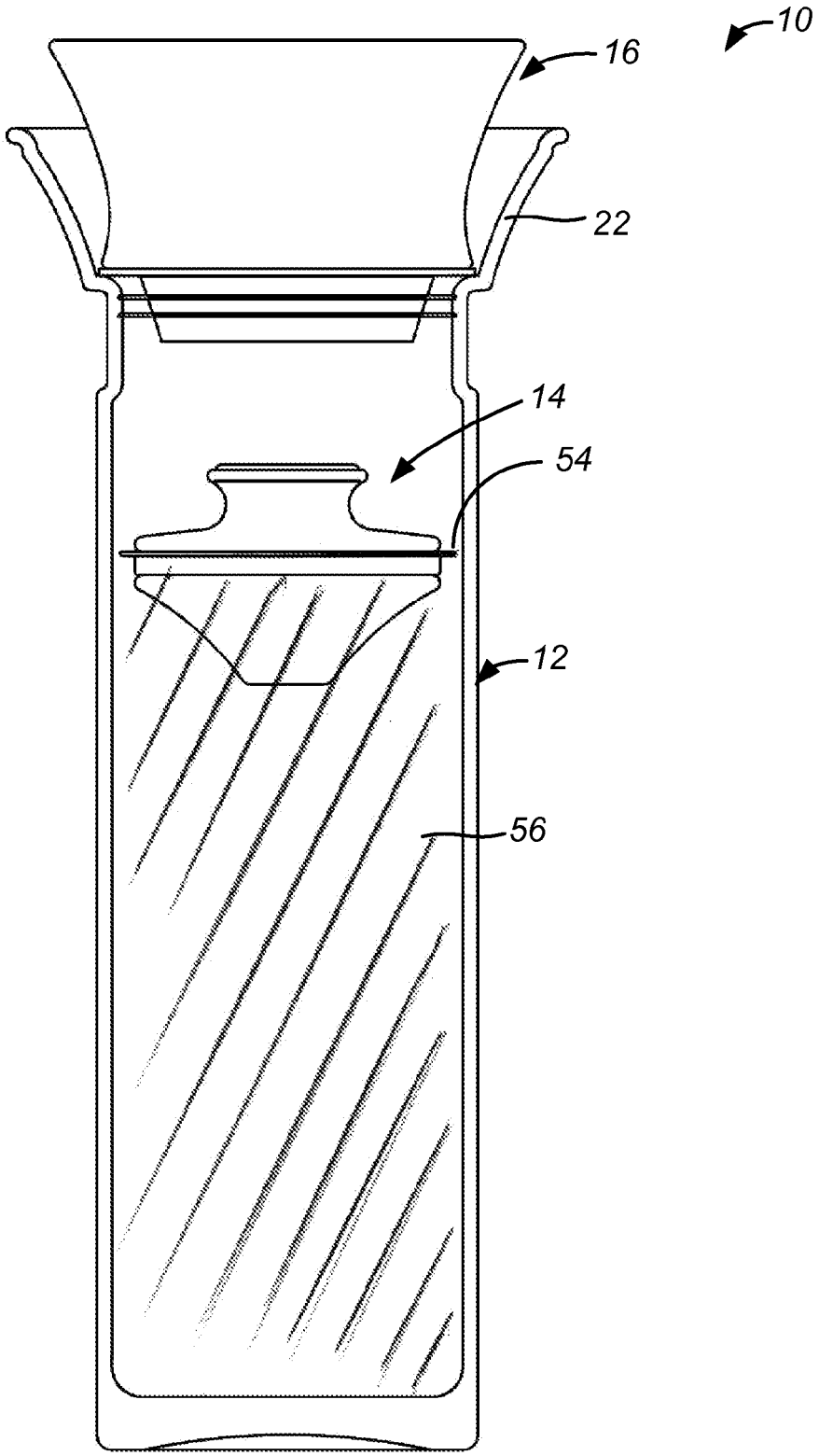

FIG. 7 shows assembly 10 in a storage condition or state. Float 14 is shown resting at the surface 54 of the liquid 56 with top 16 mounted to the open upper end of the container. Float 14 covers virtually the entire liquid surface 54 to effectively prevent air above float 14 from affecting the wine or other liquid 56 within container 12. It is therefore important that float 14 be properly buoyant so that the flange 67 of skirt 44 is at or close to liquid surface 54.

Figure 8:
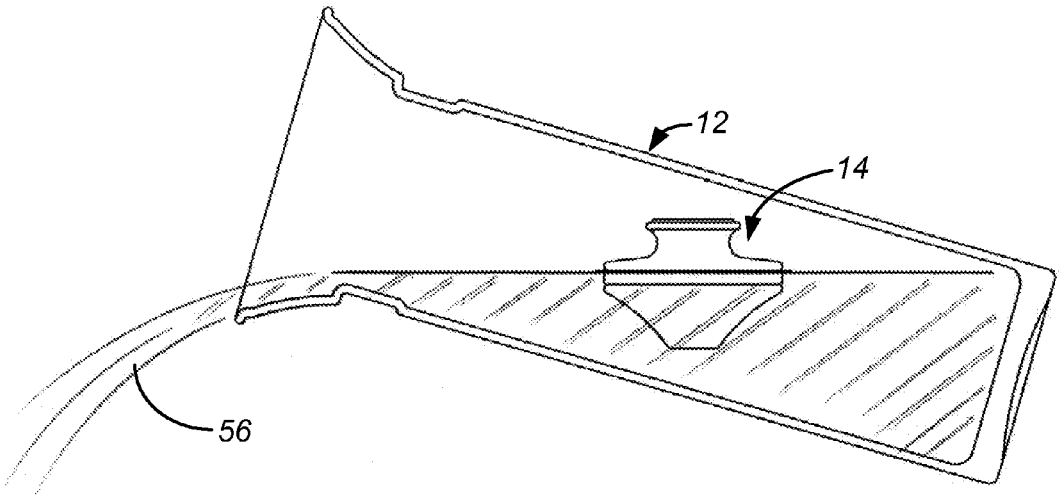

FIG. 8 shows assembly 10 of FIG. 7 after removal of top 16 with container 12 being tilted to cause liquid 56 to be poured from container 12. This figure illustrates how float 14 naturally becomes repositioned within the container interior 64 when container 12 is tilted to allow liquid 56 to be freely poured from the container.

Figure 9:
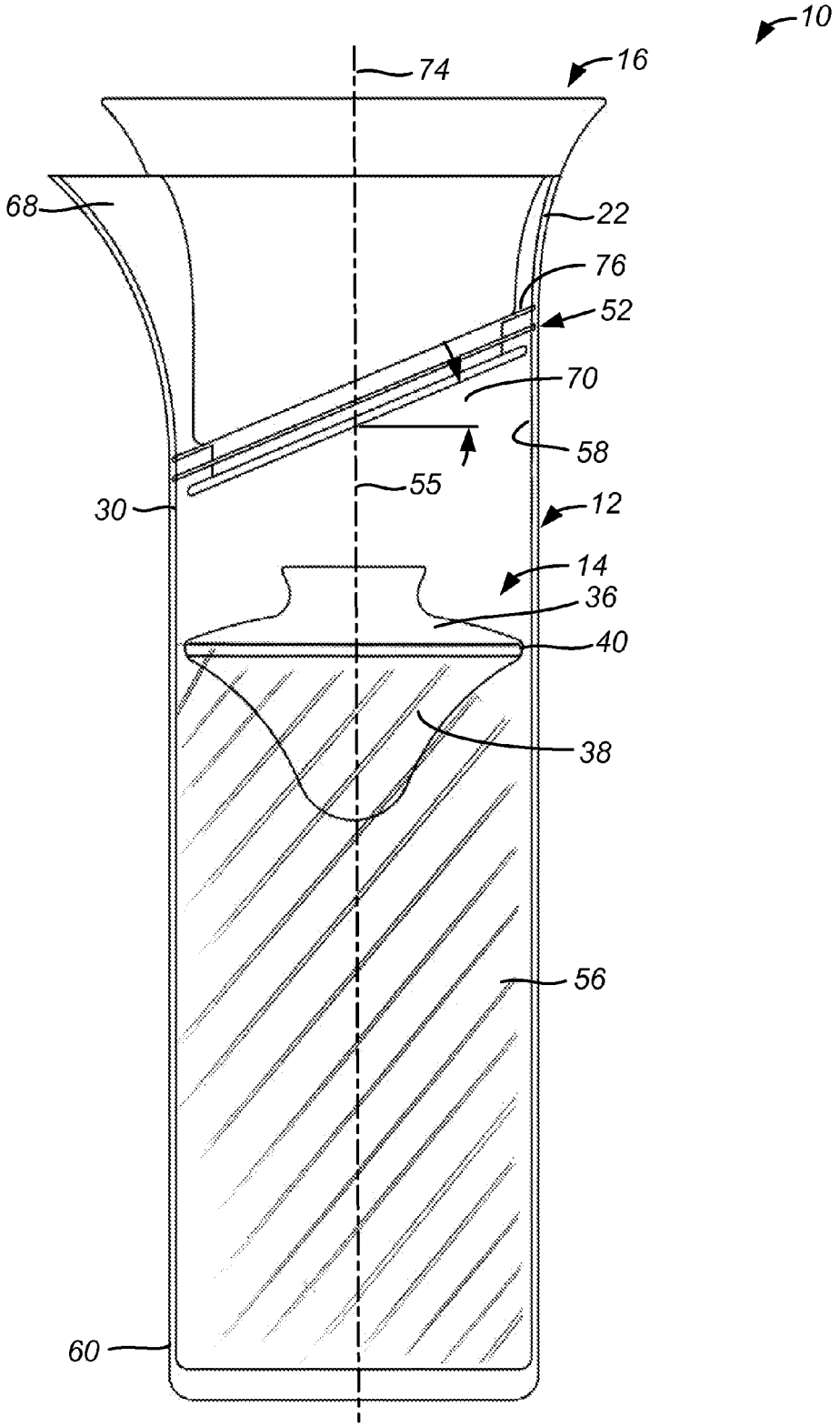
Figure 10:
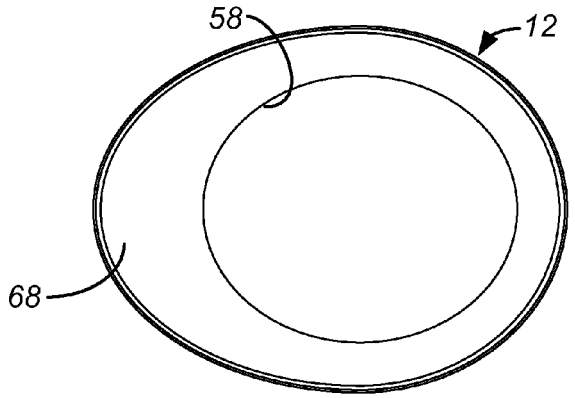
Figure 11:
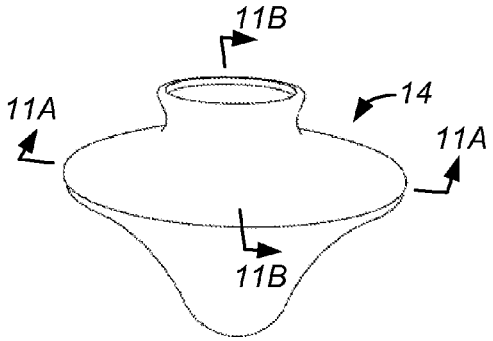
Figure 11A:
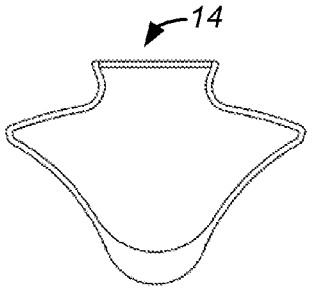
FIGS. 11A and 11B are side elevation cross-sectional views taken through the widest and narrowest portions of the float of FIG. 11.
Figure 11B:
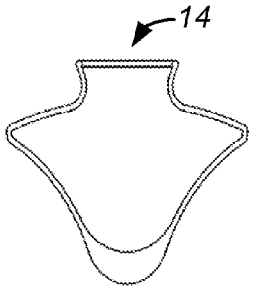
Figure 12:
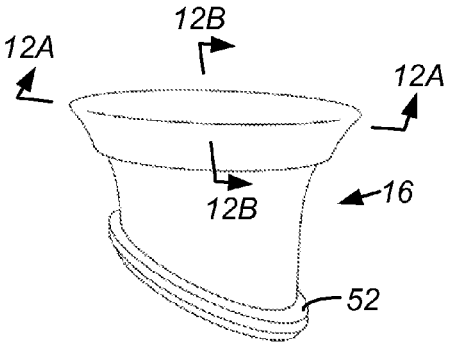
Figure 12A:
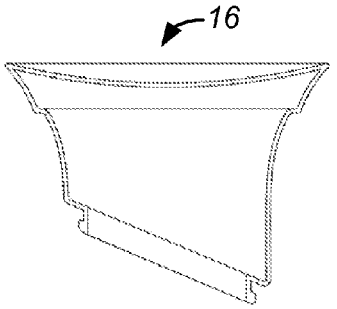
FIGS. 12A and 12B are side elevation cross-sectional views taken through the widest and narrowest portions of the top of FIG. 12.
Figure 12B:
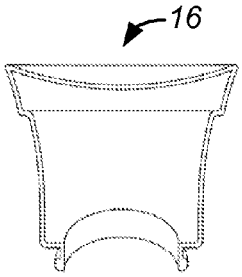

FIG. 9 shows a second example of a liquid storage, isolation and dispensing assembly 10 in which container 12 has an other than round cross-sectional shape; in this example, an oval cross-sectional shape. Other cross-sectional shapes are also possible. FIG. 10 is a top plan view of container 12 of FIG. 9 showing the oval cross-sectional shape of the container and an outwardly extending, spout-like pouring element 68 created along the outwardly flared open upper end 22 of the container. FIGS. 11, 11A, 11B, 12, 12A and 12B are three-dimensional and side elevation cross-sectional views of the float 14 and top 16 used with this example.

Top 16 of FIGS. 9-14 is similar to top 16 of FIGS. 1-8 with the main difference being that the orientation of the plane defined by top sealing element 52 is at an angle 70 to container axis 55. Top 16 has a top axis 74 which is generally coincident with axis 55. Angle 70 can be in the range of about 21° to 25°; in this example, angle 70 is 23°. Sealing element 52 has upper and lower regions 76, 78 at different positions along the sealing element. Upper region 76 is closer to upper and 22 of container 12 than is lower region 78. The upper region 76 misaligned with the spout like pouring element 68 when the top is at the liquid sealing position of FIG. 9. In this way top sealing element 52 can provide a full 360° circumferential seal by its engagement with the inner surface 58 when at the liquid sealing position of FIG. 9.

Sealing edge 40 of float 14 of FIG. 9 has the same oval shape as the inner surface 58 of container 12 between positions 30, 60. Again there is a small gap between sealing edge 40 and inner surface 58 to permit float 14 to move freely with liquid 56 during use.

Figure 13:
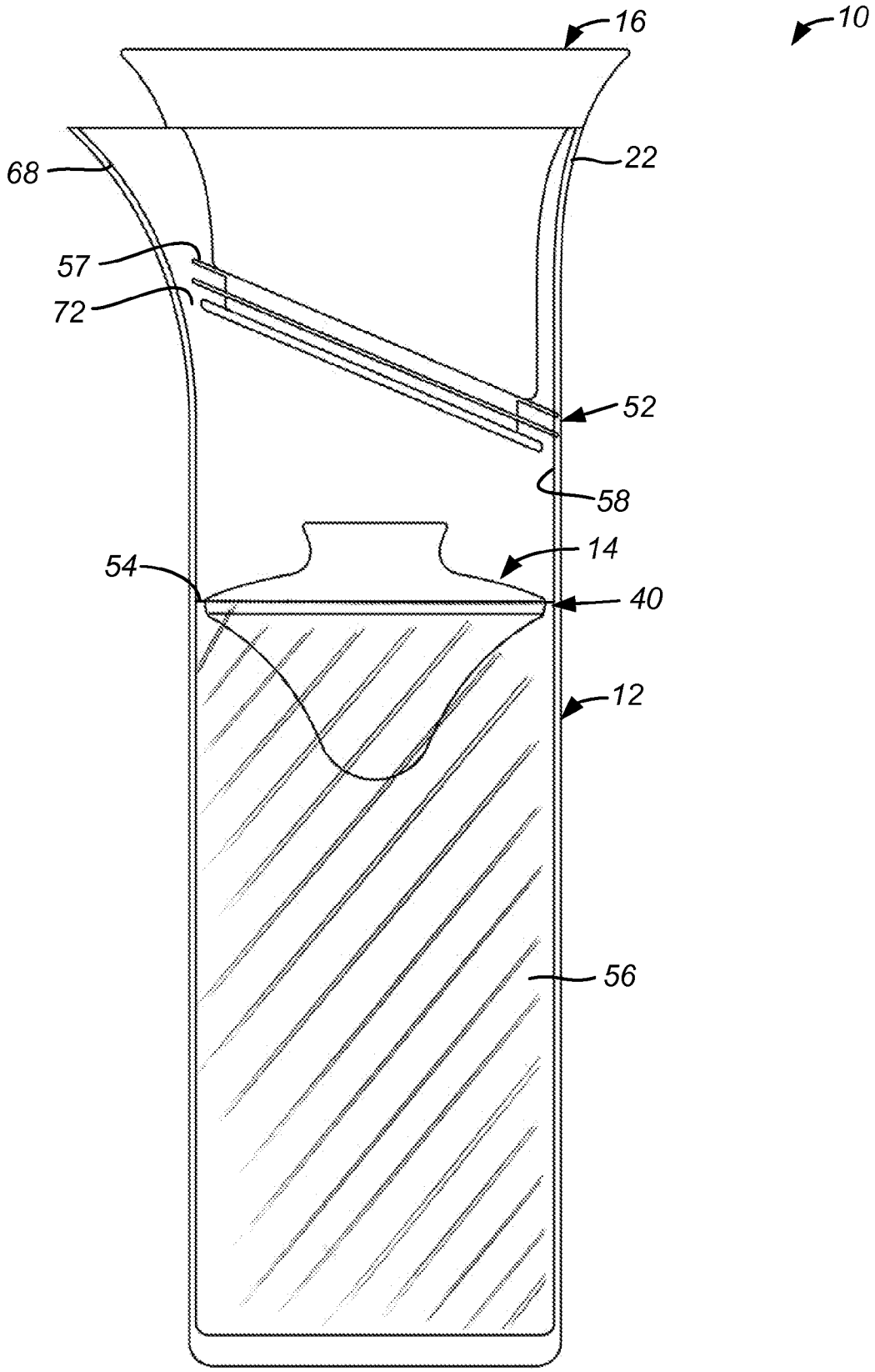

FIG. 13 shows the structure of FIG. 9 but after top 16 has been removed and re-oriented 180° from the liquid sealing position of FIG. 9. Doing so places top 16 in a liquid pouring position and causes upper region 76 to be aligned with spout like pouring element 68. This creates a gap 72 between top sealing element 52 and inner surface 58 of container 12 at the spout-like pouring element 68.

Figure 14:
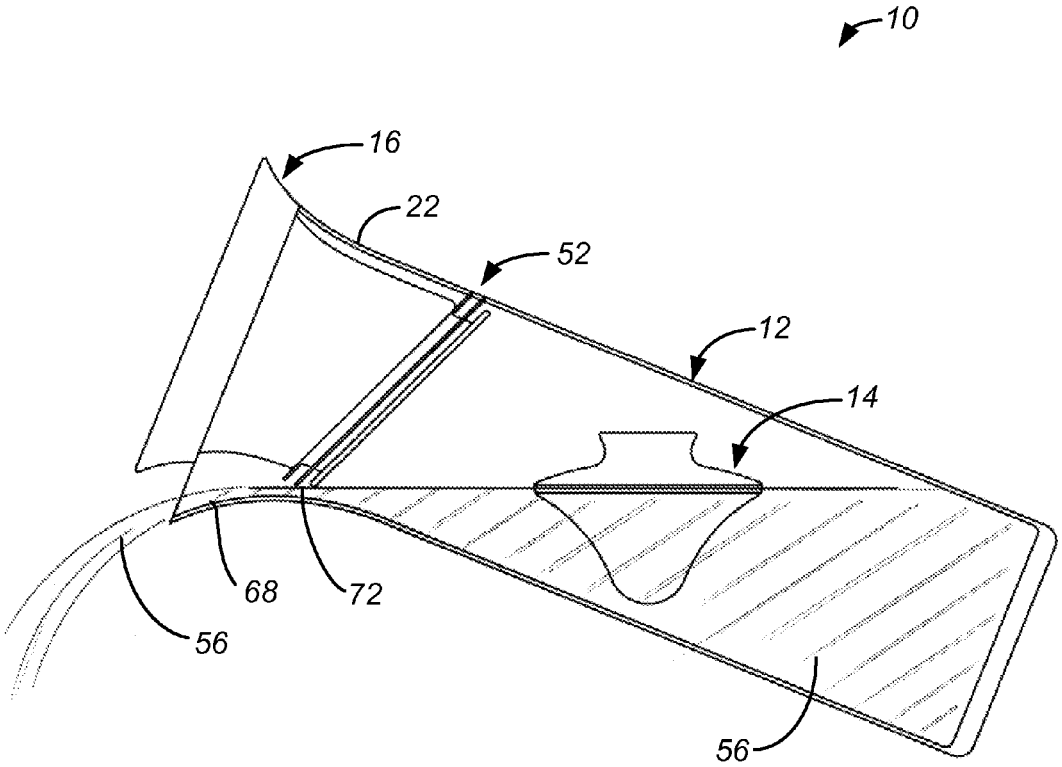
Figure 15:
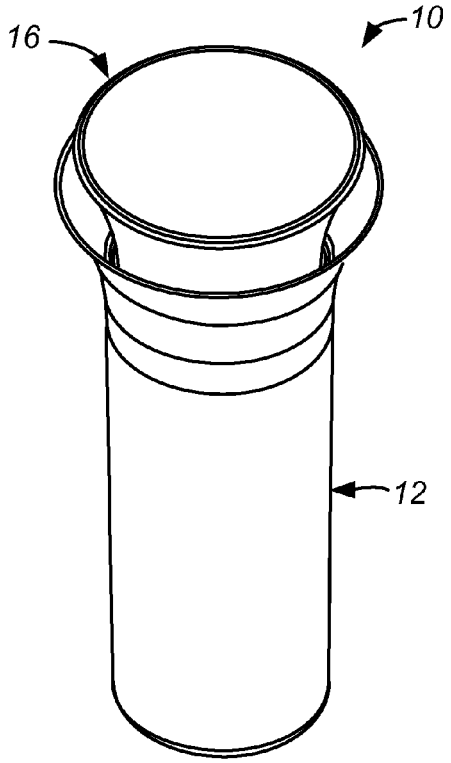
FIG. 15 is an overall view of a further example of a liquid storage, isolation and dispensing assembly.

FIG. 14 shows the structure of FIG. 13 at a tilted orientation permitting the liquid within the container to flow through gap 72. In contrast with the example of FIGS. 1-8, in which top 16 is completely removed from open upper end 22 when at the pouring position, top 16 remains mounted to open upper end 22 at the pouring position. Top 16, being mounted to open upper end 22, prevents float 14 from passing out of container 12 while pouring liquid 56. This eliminates the need for the float retaining element 62 of the FIG. 1-8 example and the need for any type of flexible flange, such as flange 67 of skirt 44.

While the present invention is disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the invention and the scope of the following claims. For example, the other than round cross-sectional shape of container 12 can be other than generally oval, such as triangular. With a triangular configuration, spout like pouring element 68 could be made at, for example, two of the corners of the triangular shaped container 12 and could have different size gaps 72 to control desired for the flow of liquid 56 out of container 12. Container axes 55 of the disclosed examples are straight lines. However, in appropriate cases container 12 could be configured so that axis 55 is not a straight line; this would, however, typically require that the cross-sectional shape and size of the inner surface 58 between positions 30 and 60 as measured along horizontal planes would need to remain constant for the gap between sealing edge 40 and inner surface 58 to remain constant.

Referring now to FIGS. 15-21, a further example of a liquid storage, isolation and dispensing assembly 10 is shown. Like elements are referred to with like reference numerals. Container 12, see FIGS. 15 and 16, includes a sidewall 24 extending from a bottom 26. Container 12 also includes a generally cylindrical lower part 80 and a generally conical, outwardly flaring upper part 82. Lower and upper parts 80, 82 are secured together at a junction 84. In one example container 12 is made of a polymer with the upper and lower parts fused to one another. In other examples container 12 could be made as a single unitary structure instead of, for example, by joining lower part 80 and upper part 82. Sidewall 24 has an inner surface 58. The inner surface 58 of lower part 80 between bottom 26 and junction 84 is cylindrical.

Figure 17:
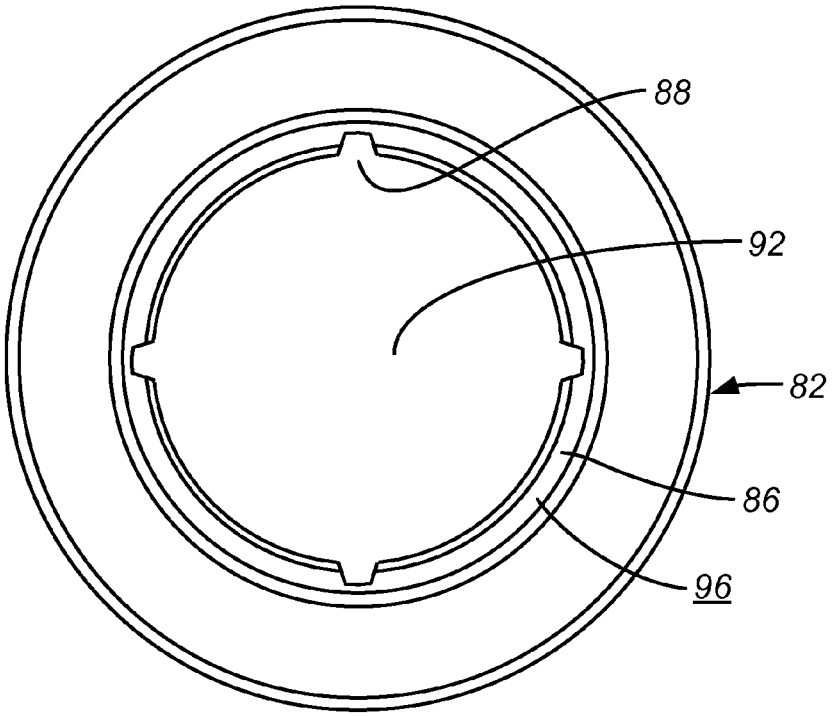
FIG. 17 is a top plan view of the upper part of the container of FIG. 15.
Figure 18:
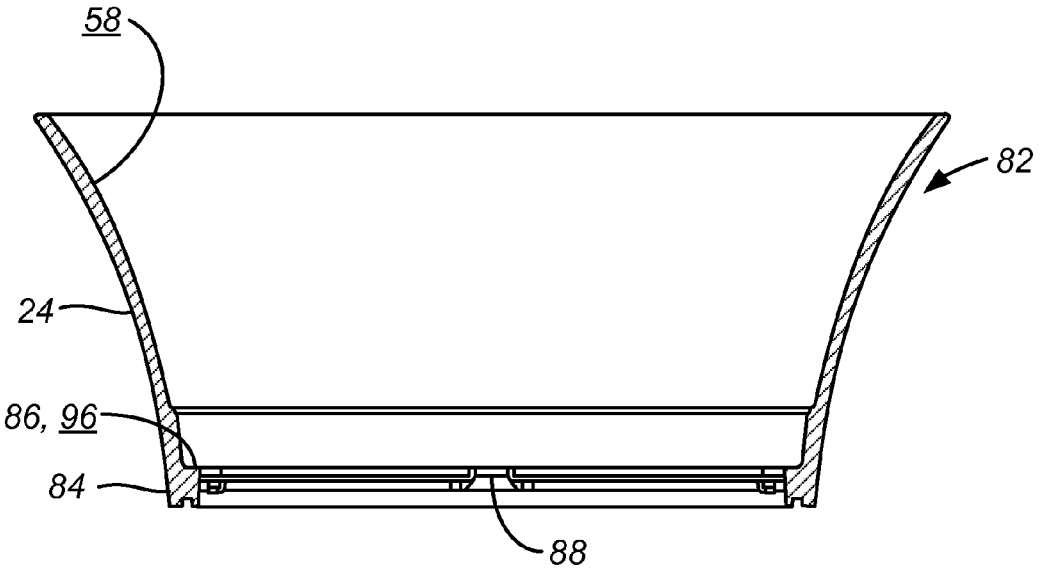
FIG. 18 is a cross-sectional view of the structure of FIG. 17.
Figure 19:
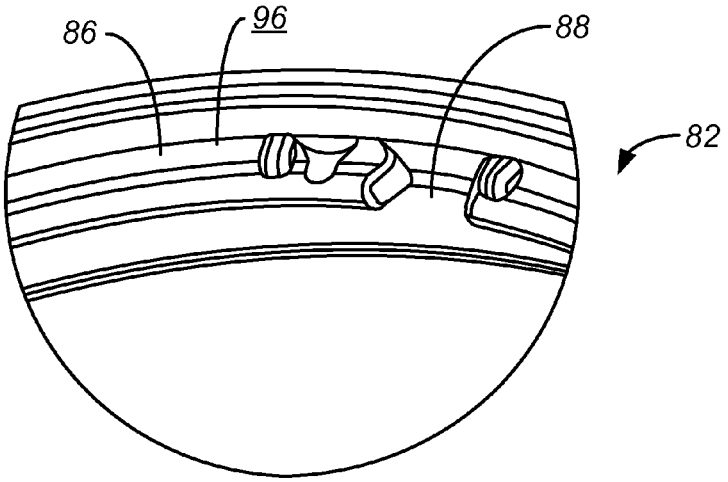
FIG. 19 is an enlarged view of a portion of the ledge of FIGS. 17 and 18 showing one of the four equally spaced cutouts in the ledge.

Referring now to FIGS. 17-19, upper part 82 has a ledge 86 extending radially inwardly from the inner surface 58 at junction 84. Ledge 86 has four equally spaced cutouts 88 formed therethrough. Cutouts 88 are sized and positioned for use with float 14 and top 16 as discussed below.

Figure 16:
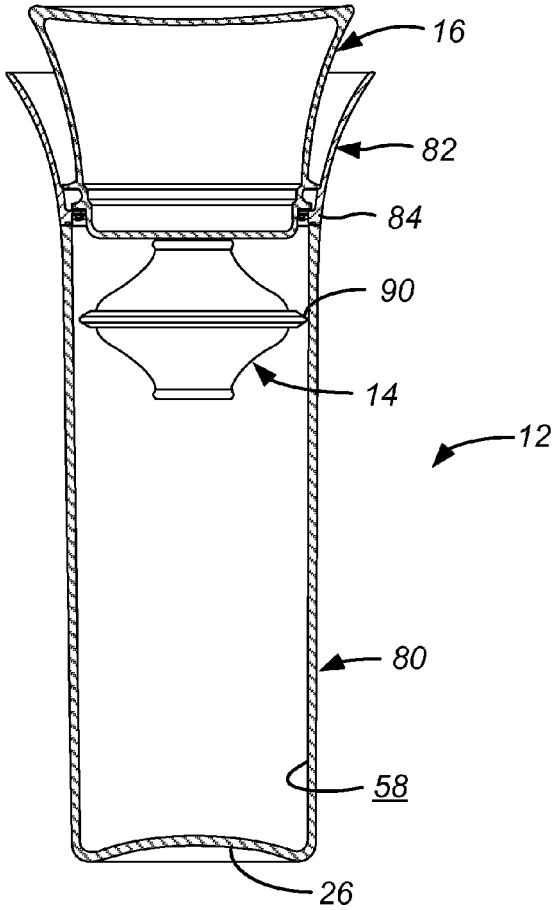
FIG. 16 is a cross-sectional view of the structure of FIG. 15.

Float 14, see FIG. 16, has a sealing edge 90 generally conforming to the size and shape of the cylindrical inner surface 58 along lower part 80. In this example sealing edge 90 is made of the same rigid polymer material as the remainder of float 14; however, sealing edge 90 could be made of a resilient or other flexible material or include a flexible edge component. Sealing edge 90 and cutouts 88 are sized and configured so that by orienting float 14 with sealing edge 90 in a vertical plane, float 14 can be inserted into lower part 80 of container 12 by passing sealing edge 90 through a pair of opposed cutouts 88 in ledge 86. However, during use ledge 86 retains float 14 within container 12 because sealing edge 90 is too large to pass through the central opening 92 of ledge 86.

Figure 20:
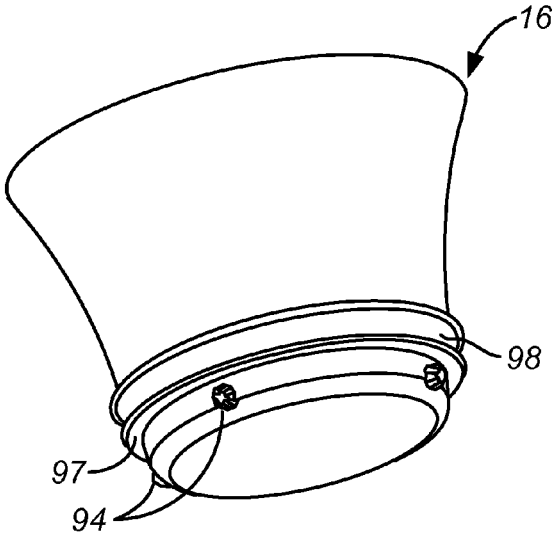
FIG. 20 is an overall view of the top of the container of FIGS. 15 and 16.
Figure 21:
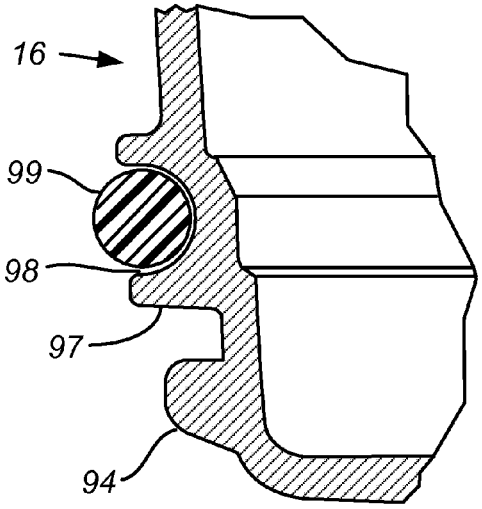
FIG. 21 is an enlarged cross-sectional view of a portion of the top of FIG. 20 passing through one of the lugs and an O-ring in an O-ring groove.

Turning now to FIGS. 20 and 21, top 16, which is mountable to upper part 82 of container 12, has four equally spaced lugs 94 sized and positioned to pass through cutouts 88 in ledge 86 for securing the top to the container. Just above lugs 94 is a downwardly facing circular ledge 97 which engages the upwardly facing upper surface 96 of ledge 86. Just above circular ledge 97 is an O-ring groove 98 within which an O-ring 99, shown only in FIG. 21, can be mounted to provide a fluid seal between top 16 and inner surface 58 of container 12. Circular ledge 97 is positioned to permit lugs 94 to pass completely through cutouts 88 to allow top 16 to be rotated a distance so that lugs 94 are no longer aligned with cutouts 88 thereby securing top 16 to container 12. The moderate frictional force which can be provided by O-ring 99 contacting inner surface 58 can be sufficient to keep top 16 from becoming inadvertently dislodged from container 12.

The number of cutouts 88 and lugs 94 can be changed. However, the number of cutouts 88 will be equal to or greater than the number of lugs 94. In one example a single lug 94 and a single cutout 88 can be used; in this example sealing edge 90 could be provided with a cutout to facilitate inserting float 14 past ledge 86 and into container 12. Sealing elements other than O-ring 99 can also be used.

In use, a liquid storage, isolation and dispensing assembly 10 can be assembled, using a container 12, a float 14 and a top 16, as follows. Container 12 includes a sidewall 24 having an inner surface 58, a lower part 80, and an upper part 82 extending from the lower part. At least a portion of the inner surface 58 of the lower part 80 has a cylindrical or other constant cross-sectional shape and size. The upper part 82 has a ledge 86 extending radially inwardly from the inner surface 58. The ledge has one or more cutouts 88, typically two or more cutouts 88, formed through it. A float 14, having a sealing edge 90 generally conforming to the size and shape of the portion of the inner surface 58, is oriented so that the sealing edge is oriented vertically and aligned with the one or more cutouts 88. The float 14 is inserted into the lower part 80 of the container 12 by passing the sealing edge 90 through the one or more cutouts 88, the cutouts being configured to permit the sealing edge to pass through the one or more cutouts. A top 16 is oriented so that it is opposite the upper part 82. The top 16 has one or more outwardly extending lugs 94 configured to pass through the one or more cutouts 88 in the ledge 86. The one or more lugs 94 are inserted through the one or more cutouts 88 in the ledge 86 to mount the top 16 to the container 12. In some examples there is a pair of cutouts 88 on opposite sides of the ledge 86 for receiving a corresponding pair of lugs 94. Thereafter the top 16 and container 12 can be rotated relative to one another to position the one or more lugs 94 to be offset from the one or more cutout 88 to secure the top 16 to the container 12.

The above descriptions may have used terms such as above, below, top, bottom, over, under, et cetera. These terms may be used in the description and claims to aid understanding of the invention and not used in a limiting sense.

Any and all patents, patent applications and printed publications referred to above are incorporated by reference.

What is claimed is:

1. A liquid storage, isolation and dispensing assembly comprising:

a container comprising:

a sidewall having an inner surface;

a lower part;

an upper part extending from the lower part;

at least a portion of the inner surface of the lower part having a constant cross-sectional shape and size; and the upper part comprising a ledge extending radially inwardly from the inner surface, the ledge comprising a cutout formed through the ledge;

a float having a sealing edge generally conforming to the size and shape of said portion of the inner surface;

the sealing edge and the cutout configured to permit the float to be passed into the lower part of the container with a portion of the sealing edge passing through the cutout;

a top mountable to the upper part, the top comprising a lug configured to pass through the cutout in the ledge for mounting the top at a first position on the container.

2. The assembly according to claim 1, wherein:

the portion of the inner surface has a cylindrical shape; and the entire upper part flares outwardly to accommodate pouring from the container in any direction.

3. The assembly according to claim 1, wherein the ledge comprises first and second cutouts.

4. The assembly according to claim 3, wherein the first and second cutouts are located on opposite sides of the ledge.

5. The assembly according to claim 1, wherein the top comprises a plurality of lugs.

6. The assembly according to claim 1, wherein the ledge has the same number of cutouts as the top has lugs.

7. The assembly according to claim 1, wherein the ledge has four cutouts and the top has four lugs.

8. The assembly according to claim 1, wherein the sealing edge is a continuous, unbroken circular sealing edge.

9. The assembly according to claim 1, wherein the top further comprises a sealing element contacting the inner surface when the top is mounted to the upper part of the container.

10. The assembly according to claim 1, wherein the lug and the ledge are configured to permit the top to be rotated relative to the container from the first position to a second position with the lug offset from the cutout thereby securing the top to the container.

11. A liquid storage, isolation and dispensing assembly comprising:

a container comprising:

a sidewall having an inner surface;

a lower part;

an upper part extending from the lower part, the entire upper part flaring outwardly to accommodate pouring from the container in any direction;

at least a portion of the inner surface of the lower part is cylindrical; and the upper part comprising a ledge extending radially inwardly from the inner surface, the ledge comprising first and second cutouts formed through the ledge on opposite sides of the ledge;

a float having a sealing edge generally conforming to the size and shape of said portion of the inner surface;

the sealing edge and the cutout configured to permit the float to be passed into the lower part of the container with a portion of the sealing edge passing through the cutout;

a top mountable to the upper part, the top comprising first and second lugs configured to pass through first and second cutouts in the ledge for mounting the top at a first position on the container, the top further comprising a sealing element contacting the inner surface when the top is mounted to the upper part of the container; and the lug and the ledge being configured to permit the top to be rotated relative to the container from the first position to a second position with the lugs offset from the cutouts thereby securing the top to the container.

12. A method for assembling a liquid storage, isolation and dispensing assembly comprising:

accessing a container, the container comprising a sidewall having an inner surface, a lower part, an upper part extending from the lower part, at least a portion of the inner surface of the lower part having a constant cross-sectional shape and size, the upper part comprising a ledge extending radially inwardly from the inner surface, the ledge comprising a cutout formed through the ledge;

orienting a float, having a sealing edge generally conforming to the size and shape of said portion of the inner surface, so that the sealing edge is aligned with the cutout;

inserting the float into the lower part of the container by passing the sealing edge through the cutout, the cutout being configured to permit the sealing edge to pass through the cutout;

orienting a top opposite the upper part, the top comprising a lug configured to pass through the cutout in the ledge; and inserting the lug through the cutout in the ledge for mounting the top to the container.

13. The method according to claim 12, wherein the accessing step comprises accessing a container having a ledge comprising a plurality of cutouts formed through the ledge.

14. The method according to claim 12, wherein the float orienting step is carried out with a float having an unbroken, circular sealing edge.

15. The method according to claim 12, wherein the container accessing step is carried out with the top comprising M lugs and the sealing edge comprising N cutouts, N being greater than or equal to M.

16. The method according to claim 12, following the lug inserting step, securing the top to the container by rotating the top and the container relative to one another to position the lug offset from the cutout.

* * * * *